US005206478A

United States Patent [19]

Lee

[11] Patent Number: 5,206,478

[45] Date of Patent: Apr. 27, 1993

[54] MICROWAVE SHIELDING FOR A DOOR OF A MICROWAVE OVEN

[75] Inventor: Ki I. Lee, Seoul, Rep. of Korea

[73] Assignee: Gold Star Co., Ltd., Youngdungpo, Rep. of Korea

[21] Appl. No.: 781,911

[22] Filed: Oct. 24, 1991

[30] Foreign Application Priority Data

Oct. 24, 1990 [KR] Rep. of Korea ..... 17046/1990
Nov. 28, 1990 [KR] Rep. of Korea ..... 19381/1990

[51] Int. Cl.[5] ..... H05B 6/76
[52] U.S. Cl. ..... 219/10.55 D; 174/35 R
[58] Field of Search ..... 219/10.55 D; 174/35 R, 174/35 GC

[56] References Cited

U.S. PATENT DOCUMENTS 4,659,891 4/1987 Yamaguchi et al. ..... 219/10.55 D
4,742,201 5/1988 Nakano et al. ..... 219/10.55 D
4,822,968 4/1989 Chin ..... 219/10.55 D
4,868,359 9/1989 Iwabuchi et al. ..... 219/10.55 D
5,036,171 7/1991 Kim et al. ..... 219/10.55 D
5,075,525 12/1991 Jung ..... 219/10.55 D

*Primary Examiner*—Philip H. Leung
*Attorney, Agent, or Firm*—Fish & Richardson

[57] ABSTRACT

A microwave shielding device for a door of a microwave oven includes a door frame and a choke seal formed integrally and of one piece with the door frame. The door frame includes a stepped portion formed at one side thereof defining a contact surface for contacting a front plate of the microwave when the door is closed. The choke seal includes an inner wall, a front wall, an outer wall, and a flange portion extending perpendicular to one another. Rectangular apertures, through-holes, and slits are formed in the outer wall portion and the flange portion to prevent leakage of microwave energy from the microwave oven.

18 Claims, 5 Drawing Sheets

MICROWAVE SHIELDING FOR A DOOR OF A MICROWAVE OVEN

1. FIELD OF THE INVENTION

This invention relates to a microwave shielding device for a door of a microwave oven and particularly, such a microwave shielding device which has an increased effect of preventing leakage of microwaves and is able to enhance a workability in manufacture by virtue of a unified structure of a door frame and a seal plate.

2. DESCRIPTION OF THE PRIOR ART

One of the prior art devices for shielding microwaves at a door of a microwave oven is of the type as shown in FIGS. 1 to 4 and comprises a door frame 1 having an inwardly bent, slitted portion 2 which is formed integrally with and along one side of the frame and has the length of $\lambda/12$($\lambda$ is a wave length) and a pitch of the period of $\lambda/4$, a seal plate 3 fixedly secured to the door frame 1 and having a bend portion which is formed integrally with and along one side of the seal plate and includes a horizontal portion 4 having the length of $\lambda/16$ and a vertical, slitted portion 5 having the length of $\lambda/16$ and a pitch of the period of $\lambda/4$ and a choke cover 6 secured to the upper surface of the slitted portion 2 of the door frame 1 to form a choke seal 7 below the cover, the seal plate 3 having a contact surface 10 of the length of $\lambda/6$ to be brought into contact with a front plate 9 of an oven body, which is provided with an inner plate 8.

With the prior microwave shielding device thus constructed, the microwaves traveling in a Z direction are attenuated by the choke seal 7 defined under the choke cover 6, and the microwaves traveling in X and Y directions are cut off by the triple structure comprising the slitted portion 2 having the length of $\lambda/12$ and slits formed therein at equal intervals so that a pitch from a leading edge of a plate portion of the slitted portion 2 to a tailing edge of the slit has the period of $\lambda/4$ and the horizontal and vertical, slitted portions 4 and 5 of the seal plate 3 each having the length of $\lambda/16$, the vertical, slitted portion 5 having slits formed therein at equal intervals so that a pitch from a leading edge of a plate portion of the slitted portion 5 to a trailing edge of the slit has the period of $\lambda/4$.

On the other hand, the microwaves not only travel in the regular directions of X, Y and Z but also are irregularly reflected. Therefore, the microwaves traveling in the directions of XZ and XY components, which are the resultant components of X and Z and X and Y, respectively, are attenuated by the slitted portion 2 provided at one side of the door frame 1 to have the pitch of the period of $\lambda/4$ and the bend portion of the seal plate 3 comprising the horizontal portion 4 of the length of $\lambda/16$ and the vertical, slitted portion 5 having the length of $\lambda/16$ and the pitch of the period of $\lambda/4$.

This prior microwave shielding device for the door of the microwave oven however has various drawbacks as follows:

1. Since the choke cover 6 does not cover the entire exterior surface of the portion of the door which is brought into contact with the oven body, and the contact surface 10 forms a portion of the exterior surface, the door when open exhibits unsightly appearance.

2. There is required a spot welding process to join the separately formed seal plate 3 to the door frame 1, resulting in complicated, tedious manufacturing work. Also, the requirement of the increased parts results in higher manufacturing cost and lower productivity.

3. In case that the inner plate 8 of the oven body is displaced leftward as indicated by the dot-and-dash lines in FIG. 2, the contact surface 10 of the seal plate 3 having the length of $\lambda/6$ and brought into contact with the front plate 9 of the oven body is reduced to the length of $\lambda/32$, there by lowering shielding efficiency and thus causing excessive leakage of the microwave. As a result, the prior art has encountered with the problem that distance between the front plate 9 and the inner plate 8 must be large, so that the opening rate of the cavity may not be increased.

SUMMARY OF THE INVENTION

In view of the aforesaid drawbacks of the prior device, it is an object of the present invention to provide a microwave shielding device for a door of a microwave oven, which is able to enhance shielding efficiency and productivity by virtue of improved, simple shielding structure in which productivity by virtue of improved, simple shielding structure in which a seal plate is unified with a door frame, without separately forming the door frame and the seal plate.

To achieve the above object, there is provided according to a form of the present invention a microwave shielding device for a door of a microwave oven, comprising a door frame with a seal plate unified therewith, a bend portion formed at one side of the door frame to have contact and noncontact surfaces, the contact surface being brought into contact with a front plate of an oven body when the door is closed and a choke seal provided by a vertically bent portion formed to extend along one side of the bend portion and a flange portion provided at an upper end of the vertically bent portion.

BRIEF DESCRIPTION OF THE DRAWINGS

The invention will be more fully understood from the following detailed description thereof, taken in connection with the accompanying drawings, in which.

DESCRIPTION OF THE PREFERRED EMBODIMENT

Figure 1:
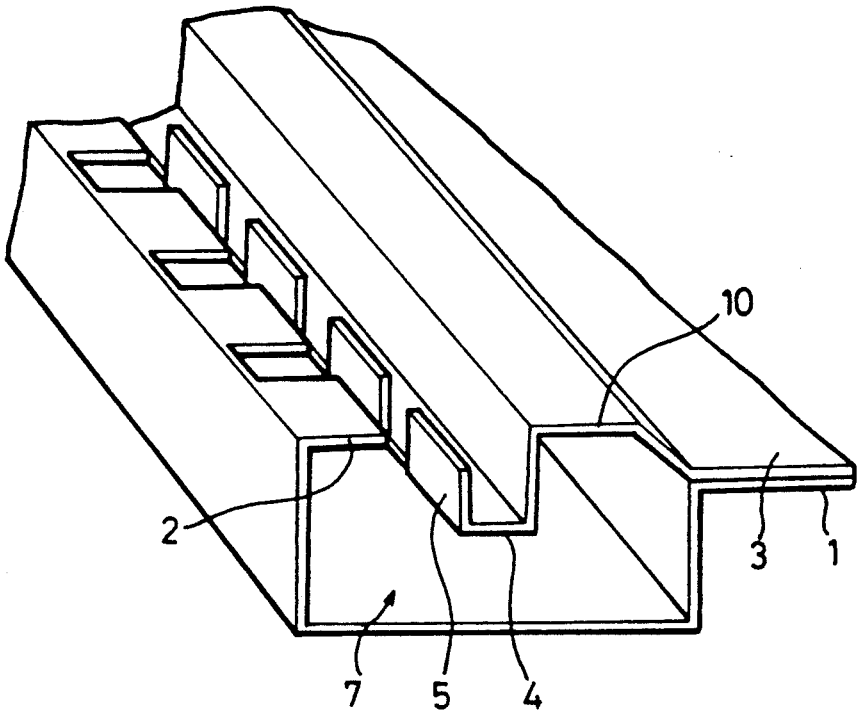
F I G . 1 PRIOR ART
FIG. 1 is a fragmentary perspective view showing a door frame of a prior microwave oven and a seal plate joined to the frame.
Figure 2:
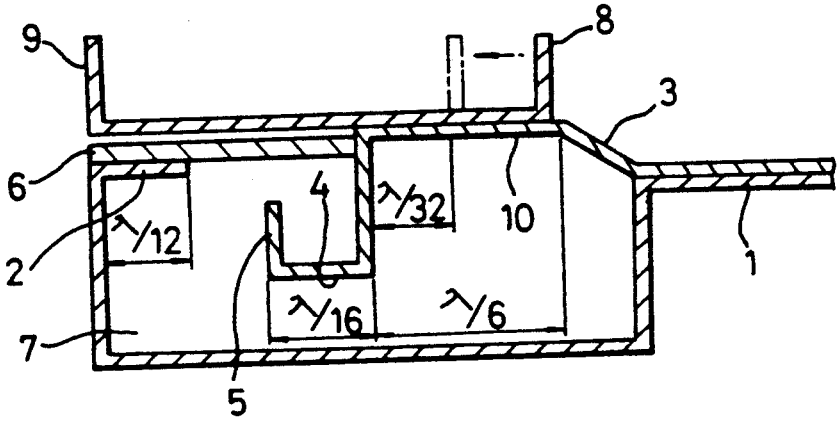
F I G . 2 PRIOR ART
FIG. 2 is a cross-sectional view of a portion of a door of the prior microwave oven.
Figure 3:
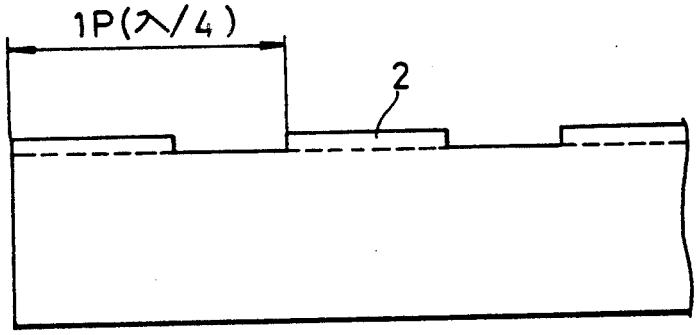
FIG. 3 PRIOR ART
FIG. 3 is a side view of a slitted portion of the door frame as seen from the right side in FIG. 1.
Figure 4:
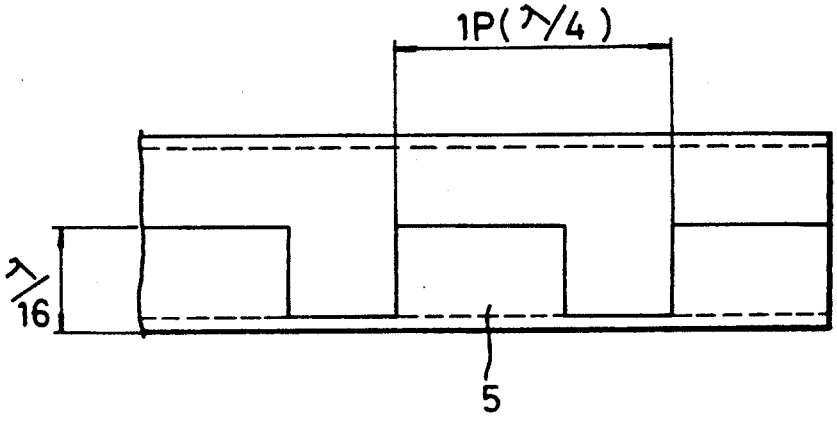
FIG. 4 PRIOR ART
FIG. 4 is a side view of vertical, slitted portion of the seal plate as seen from the left side in FIG. 1.
Figure 5:
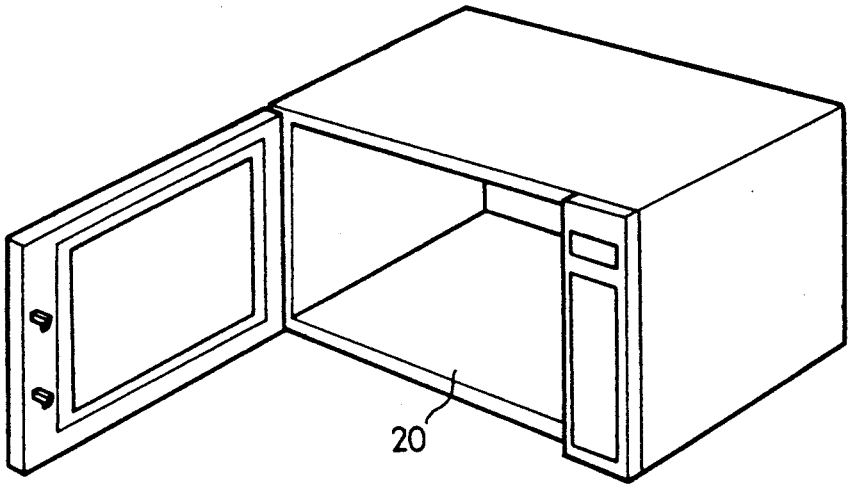
FIG. 5 is a perspective view of a microwave oven to which a microwave shielding device according to the present invention is applied.
Figure 6:
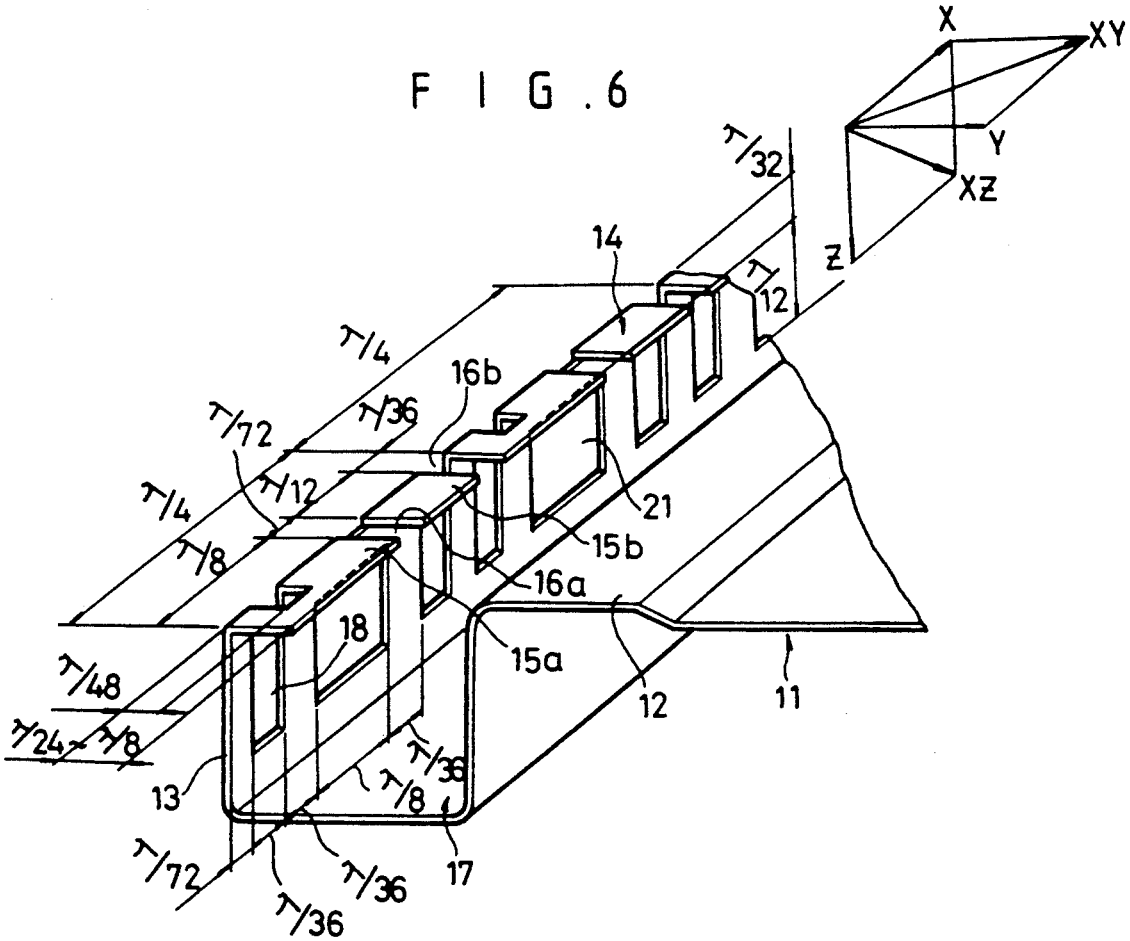
FIG. 6 is a fragmentary perspective view of a door frame according to an embodiment of the present invention.
Figure 8:
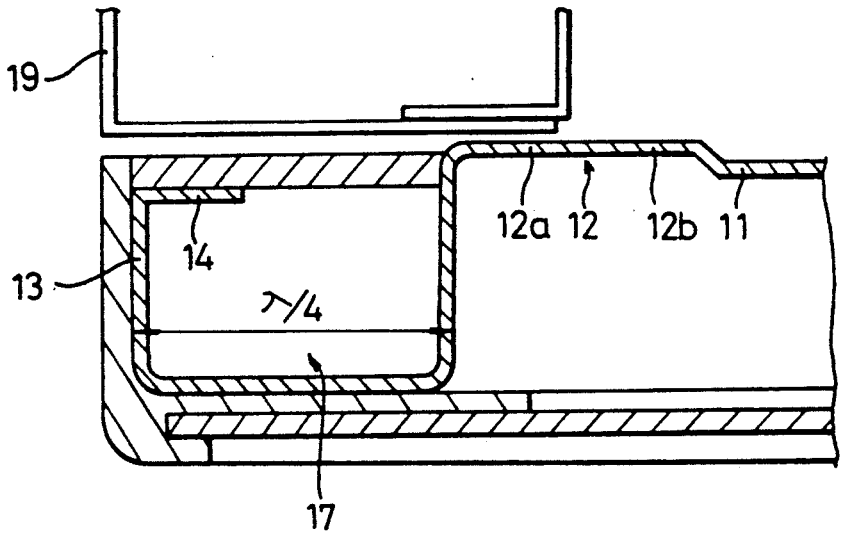
FIG. 8 is a cross-sectional view of the portion of the microwave oven incorporating the device of the present invention.

Reference is first made to FIGS. 5, 6 and 8 which illustrate a microwave oven to which present invention is applied, and a door frame incorporating an embodiment of the present invention. A device according to the present invention has a composite of choke seal structure and metal-to-metal seal structure. Such construction will now be described in more detail with reference to FIGS. 6 and 8. According to the present invention, the door frame 11 has a seal plate unified therewith and is provided with a bend portion 12 (i.e., a stepped portion) formed at one side thereof and having a contact surface 12*a* and a noncontact surface 12*b*, the contact surface 12*a* being brought into contact with a front plate 19 of an oven body to close a cavity 20 of the body. Further, the bend portion 12 has a vertically bent portion 13 formed along one side thereof and a flange portion 14 extending horizontally from an upper end of the vertically bent portion. The vertically bent portion 13 and the flange portion 14 define a choke seal 17 acting to attenuate the microwaves traveling in a Z direction. Also, in order to attenuate the microwaves traveling in X and Y directions a metal-to-metal system is provided by contact between the oven body and the vertically bent portion 13 of the door frame 11.

Although the door frame 11 having the unified structure as discussed above acts to cut off the microwave reflected in the X, Y and Z directions, besides the regular reflected in the X, Y and Z directions the microwaves are also irregularly reflected in XY and XZ and directions. Therefore, in order to attenuate the irregularly reflected microwaves, the flange portion 14 having the length in the range of λ/24 to λ/8 is provided at the top of the vertically bent portion 13. As shown in FIG. 6 the flange portion 14 has repeating pitches each having the period of λ/4 and comprises, in one pitch, first and second flanges 15*a* and 15*b* having the dimensions in the X direction of λ/8 and λ/12, respectively, a first slit 16*a* formed between the first and second flange 15*a* and 15*b* and having the width in the X direction of λ/72, and a second slit 16*b* having the width in the X direction of λ/36 and the length in the Z direction of λ/12. There is formed a through hole 18 extending from a middle position of the first flange 15*a* to a position near the lower end of the vertically bent portion 13 and having the width in the X direction of λ/36, the length in the Y direction of λ/48 and the length in the Z direction of λ/12. In addition, there is formed in the vertically bent portion 13 between the through hole and the second slit a rectangular aperture 21 of the size of λ8×λ/12 acting to attenuate the microwaves reflected in the XY and XZ directions and others.

Figure 7:
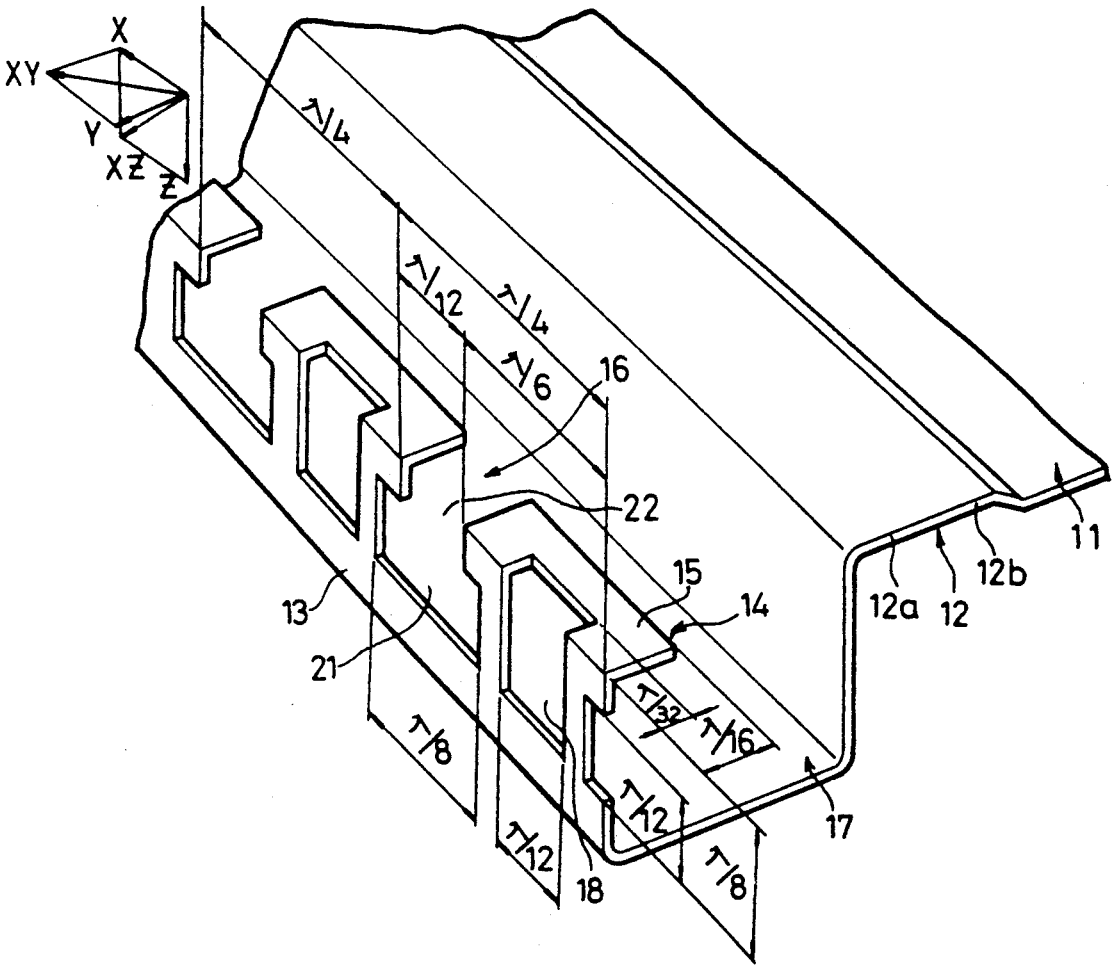
FIG. 7 is a fragmentary perspective view of a door frame according to another embodiment of the present invention.

FIG. 7 shows a perspective view of the door frame according to another embodiment of the present invention. This embodiment is identical with above discussed embodiment in that the door frame 11 has the seal plate unified therewith and is provided with the bend portion 12 formed at one side thereof and having the contact surface 12*a* and the noncontact surface 12*b*, and the choke seal 17 defined by the vertically bent portion 13 formed along one side of the bend portion and the flange portion 14 extending horizontally from the upper end of the vertically bent portion, the choke seal acting to attenuate the microwaves traveling in the Z direction.

However, an arrangement of this embodiment for attenuating the microwaves irregularly reflected in the XY and XZ directions is different from that of the previous embodiment and will be explained in detail below.

As shown in FIG. 7, the flange portion 14 bent inwardly from the upper end of the vertically bent portion 13 of the door frame 11 has the length in the Y direction of λ/16 and a pitch of the period of λ/4 and includes a flange 15 having the width in the X direction of λ/6 and a slit 16 having the width in the X direction λ/12. Also, the through hole 18 extending from the middle position of the flange portion 14 to the position near the lower end of the vertically bent portion 13 has the width in the X direction of λ/12, the length in the Y direction of λ/32 and the length in the Z direction of λ/8. The rectangular aperture 21 of the size of λ/8×λ/12 is formed between the flange portions 14 and in communication with the slit 16 through an opening 22 which is provided at the upper side of the rectangular aperture and has the width in the X direction of λ/12.The choke seal 17 formed between the vertically bent portion 13 and the vertical portion of the bend portion 12 has the dimension of λ/4.

In this way, as in the first embodiment of the present invention, the microwaves traveling in the Z direction are attenuated by the choke seal 17 formed between the bend portion 12 and vertically bent portion 13 of the door frame 11, while the microwaves in the X and Y directions are attenuated by the vertically bent portion 13 of the door frame. At this time, the microwaves irregularly reflected to travel in the XY and XZ directions which are the resultant components of X and Y, and X and Z, respectively, are attenuated by the flange portions 14, which are bent inwardly from the upper end of the vertically bent portion 13, comprise the flanges 15 of the width in the X direction of λ/6 and the slits 16 of the width in the X direction of λ/12 arranged in alternating relationship and have a pitch of the period of λ/4 defined by the distance between the leading edge of the flange 15 and the tailing edge of the slit 16, and in which the through holes 18 are the formed between the middle position of the flange and the position near the lower end of the vertically bent portion 13 to have the width in the X direction of λ/12, the length in the Y direction of λ/32 and the length in the Z direction of λ/8, the rectangular apertures 21 of the size of λ/8×λ/12 being in communication with the slits 16 through the openings 22 each having the width in the X direction of λ/12.

The dimensions of λ/4, λ/8, λ/12, λ/24, λ/36 and λ/72 in the first embodiment of the present invention and λ/4, λ/6, λ/8, λ/12 and λ/16 in the second embodiment are based on TE mode (Transverse Electric Mode or Wave means the mode in which an electric field does not exist in the wave traveling direction, i.e., in the Z direction). In the TE (mn) mode, the distributions of the electric fields in the X and Y directions are expressed by the following equations:

$$\Sigma x = \sum_{m=0}^{\infty}\sum_{m=0}^{\infty}\frac{j\omega\mu n\pi}{kc^2 b} Hmn \operatorname{Cos}\left(\frac{m\pi}{a}X\right)\operatorname{Sin}\left(\frac{n\pi}{b}Y\right)e^{-j\beta gz} \quad \text{(i)}$$

$$\Sigma y = \sum_{m=0}^{\infty}\sum_{m=0}^{\infty}\frac{-j\omega\mu m\pi}{kc^2 a} Hmn \operatorname{Sin}\left(\frac{m\pi}{a}X\right)\operatorname{Cos}\left(\frac{n\pi}{b}Y\right)e^{-j\beta gz} \quad \text{(ii)}$$

wherein $Kc^2 = (m\pi/a)^2 + (n\pi/b)^2$, $$\beta g = \sqrt{K^2 - Kc^2},$$

-continued $K^2 = \omega^2\epsilon\mu$, and $Hmn$ is an optional constant.

And, $$\lambda c \text{ (Cut-off wave length)} = \sqrt{\lambda\ (m/a)^2 + (n/b)^2} \quad \text{(iii)}$$

$$\lambda g \text{ (Guided wave length)} = \sqrt{\lambda\ 1 - (\lambda/\lambda c)^2} \quad \text{(iv)}$$

wherein m and n are electric field constants in the X and Y directions, respectively, and λ is a free space wave length (λ=velocity of propagation per second/frequency =300,000 Km/sec/2450 MHz =12.2 cm).

Therefore, to allow a microwave having any frequency to be transmitted in a wave guide, the value of λ must be less than the value of λc, and the value of λg must be greater than the value of λ. Since the actual clearance of the door of the microwave oven is extremely small (the clearance approximately equals zero), the value of λc is correspondingly small extremely. In this event, since λ has the value much greater than λc, a mode in the Y direction is not formed, resulting in the uniform distribution of the electric field. That is, in the TE (m.n) mode, the value of a gradually becomes zero.

Considering only the TE(m.o) mode, therefore, Equations i and iv mentioned above are expressed as follows:

$$Ex = 0 \quad \text{(v)}$$

$$Ey = Eo \sum_{n=0}^{\infty} \mathrm{Sin}(m\pi/a \cdot X) \text{ (Eo is a constant)} \quad \text{(vi)}$$

$$\lambda c = 2a/m \quad \text{(vii)}$$

$$\lambda g = \sqrt{\lambda\ 1 - (m\lambda/2a)^2} \quad \text{(viii)}$$

If Equation vi is differentiated for X to seek the point at which the electric field in the X direction is at a maximum, the equation, $Ey' = C \cdot \mathrm{Cos}(m\pi/a \cdot X)$ is obtained, where in C is an optional constant. Here, the point at which the value of Ey' equals zero is the point providing the maximum value of Ey. Therefore, when the value of Ey' equals zero, the following equation is obtained:

$$\mathrm{Cos}\left(\frac{m\pi}{a} X\right) = 0, \frac{m\pi}{a} \cdot X \frac{N\pi}{2} \ (N = 1, 3, 5, \ldots 2m - 1)$$

As a result, since the point at which the value of X equals the value $$\frac{N \cdot a}{2m},$$

is the point providing the maximum electric field, if a suitable turning post is disposed at the point, transmission of the wave may be restrained most effectively. In this way, shielding of the microwaves may be accomplished by the vertically bent portion 13 acting to attenuate the microwaves in the X and Y direction, both the bent portion and the choke seal 17 acting to attenuate the microwaves in the Z direction, both the bent portion and the choke seal being formed at the door frame 11. The door frame 11 is further provided at one side thereof with the flange portion 14 formed to extend inwardly from the upper end of the vertically bent portion 13 to attenuate the microwaves in the directions of the resultant components of X and Y, and X and Z. As a result, there is provided according to the present invention the triple shielding structure for attenuating the microwaves in all the directions.

As discussed above, the present invention provides an efficient device to excellently shield the microwaves by the vertically bent portion 13 formed at the given portion of the door frame 11 and the flange portion 14 formed to extend inwardly from the bent portion 13 without lowering of the microwave shielding efficiency even during the long use of the microwave oven.

Furthermore, the present invention provides advantages in that the unified structure of the door frame 11 and the seal plate and the improved configuration of the flange portion 14 requires the few components, resulting in lower manufacturing cost and easy manufacturing and assembling work, and that the size of the front opening of the oven body may be increased over provided by the prior art, thereby increasing the capacity of the cavity.

While the invention has been shown and described with particular reference to two embodiments thereof, it will be understood that variations and modifications may be made therein without departing from the spirit and scope of the invention as defined in the appended claims.

What is claimed is:

1. A microwave shielding device for a door of a microwave oven, comprising:

a door frame having a stepped portion formed at one side thereof defining a surface portion for contacting a front plate of the microwave oven when the door is closed; and a choke seal formed integrally and of one piece with the door frame for preventing leakage of microwave energy from the microwave oven, wherein choke seal comprises:

an inner wall extending from the door frame perpendicular to the stepped portion, a front wall extending perpendicularly from a distal end portion of the inner wall, an outer wall extending perpendicularly from a distal end portion of said front wall, and a flange extending perpendicularly from a distal end portion of the outer wall and toward the stepped portion;

wherein a plurality of through-holes are formed in the outer wall and the flange, each said through-hole extending over a boundary between the outer wall and the flange;

wherein a rectangular aperture is formed in the outer wall between each through-hole; and wherein a plurality of slits are formed in the flange.

2. A microwave shielding device as claimed in claim 1, wherein one of the slits extends over the boundary between the outer wall and the flange.

3. A microwave shielding device as claimed in claim 2, wherein the slits are separated along the flange by a distance which alternates between λ/8 and λ/12, where λ is the wavelength of the microwave energy in the microwave oven.

4. A microwave shielding device as claimed in claim 1, wherein the slits are formed at positions on the flange corresponding to the rectangular apertures formed in the outer wall.

5. A microwave shielding device as claimed in claim 4, wherein the slits do not communicate with the corresponding rectangular apertures.

6. A microwave shielding device as claimed in claim 5, wherein the slits are separated along the flange by a distance which alternates between λ/8 and λ/12, where λ is the wavelength of the microwave energy in the microwave oven.

7. A microwave shielding device as claimed in claim 1, wherein the flange has a pitch of λ/4, where λ is the wavelength of the microwave energy in the microwave oven.

8. A microwave shielding device as claimed in claim 1, wherein the flange has a width in the direction normal to the outer wall in the range of λ/24 to λ/8, where λ is the wavelength of the microwave energy in the microwave oven.

9. A microwave shielding device as claimed in claim 1, wherein the slits are separated along the flange by a distance which alternates between λ/8 and λ/12, where λ is the wavelength of the microwave energy in the microwave oven.

10. A microwave shielding device as claimed in claim 1, wherein the width of the slits in a direction parallel to the outer wall alternates between λ/72 and λ/36, where λ is the wavelength of the microwave energy in the microwave oven.

11. A microwave shielding device as claimed in claim 10, wherein one of the through-holes has dimensions of λ/36 by λ/48 in the flange and λ/36 by λ/12 in the outer wall, where λ is the wavelength of the microwave energy in the microwave oven.

12. A microwave shielding device as claimed in claim 1, wherein one of the through-holes has dimensions of λ/36 by λ/48 in the flange and λ/36 by λ/12 in the outer wall, where λ is the wavelength of the microwave energy in the microwave oven.

13. A microwave shielding device as claimed in claim 1, wherein the rectangular apertures formed in the outer wall have dimensions of λ/8 by λ/12, where λ is the wavelength of the microwave energy in the microwave oven.

14. A microwave shielding device as claimed in claim 1, wherein the flange has a pitch of λ/4 and a width in the direction normal to the outer wall of λ/16, wherein the slits are separated along the flange by a distance of λ/6, and the width of each slit is λ/12, where λ is the wavelength of the microwave energy in the microwave oven.

15. A microwave shielding device as claimed in claim 14, wherein the slits are formed at positions on the flange corresponding to the rectangular apertures formed in the outer wall, wherein each slit communicates with a corresponding one of the rectangular apertures, and wherein the rectangular apertures have dimensions of λ/8 by λ/12, where λ is the wavelength of the microwave energy in the microwave oven.

16. A microwave shielding device as claimed in claim 1, wherein the through-holes have dimensions in the flange of λ/32 by λ/12 and dimensions in the outer wall of λ/8 and λ/12, where λ is the wavelength of the microwave energy in the microwave oven.

17. A microwave shielding device for a door of a microwave oven, comprising:

a door frame having a stepped portion formed at one side thereof defining a contact surface for contacting a front plate of the microwave oven when the door is closed; and a choke seal formed integrally and of one piece with the door frame for preventing leakage of microwave energy from the microwave oven, wherein said choke seal comprises:

an inner wall extending from the door frame perpendicular to the stepped portion, a front wall extending perpendicularly from a distal end portion of the inner wall, an outer wall extending perpendicularly from a distal end portion of said front wall, and a flange extending perpendicularly from a distal end portion of the outer wall and toward the stepped portion;

wherein a plurality of through-holes are formed in the outer wall and the flange, each said through-hole extending over a boundary between the outer wall and the flange;

wherein a rectangular aperture is formed in the outer wall between each through-hole;

wherein a plurality of slits are formed in the flange extending over the boundary between the outer wall and the flange;

wherein a distance between adjacent slits is equal to λ/4, the slits are separated along the flange by a distance which alternates between λ/8 and λ/12, and the width of the slits along the flange alternates between λ/72 and λ/36;

wherein the through-holes have dimensions of λ/36 by λ/48 in the flange and λ/36 by λ/12 in the outer wall; and wherein the rectangular apertures formed in the outer wall have dimensions of λ/8 by λ/12, where λ is the wavelength of the microwave energy in the microwave oven.

18. A microwave shielding device for a door of a microwave oven, comprising:

a door frame having a stepped portion formed at one side thereof defining a contact surface for contacting a front plate of the microwave oven when the door is closed; and a choke seal formed integrally and of one piece with the door frame for preventing leakage of microwave energy from the microwave oven, wherein said choke seal comprises:

an inner wall extending from the door frame perpendicular to the stepped portion, a front wall extending perpendicularly from a distal end portion of the inner wall, an outer wall portion extending perpendicularly from a distal end portion of the front wall, and a flange extending perpendicularly from a distal end portion of the outer wall and toward the stepped portion;

wherein a plurality of through-holes are formed in the outer wall and the flange, each said through-hole extending over a boundary between the outer wall and the flange;

wherein a rectangular aperture is formed in the outer wall between each through-hole;

wherein a plurality of slits are formed in the flange at positions corresponding to the rectangular apertures formed in the outer wall, each slit communicates with a corresponding one of the rectangular apertures, and the rectangular apertures have dimensions of λ/8 by λ/12;

wherein the flange has a pitch of λ/4 and a width in the direction normal to the outer wall of λ/16, the slits are separated along the flange by a distance of λ/6, and the width of each slit in a direction parallel to the outer wall is λ/12; and wherein the through-holes have dimensions in the flange of λ/32 by λ/12 and dimensions in the outer wall of λ/8 and λ/12, where λ is the wavelength of the microwave energy in the microwave oven.

* * * * *